US007295169B2

(12) United States Patent
Motoyama

(10) Patent No.: US 7,295,169 B2
(45) Date of Patent: Nov. 13, 2007

(54) ANTENNA PROBE HAVING ANTENNA PORTION, LOW NOISE CONVERTER WITH ANTENNA PROBE AND METHOD OF CONNECTING ANTENNA PROBE HAVING ANTENNA PORTION

(75) Inventor: Kohji Motoyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 21 days.

(21) Appl. No.: 11/335,530

(22) Filed: Jan. 20, 2006

(65) Prior Publication Data

US 2006/0192722 A1 Aug. 31, 2006

(30) Foreign Application Priority Data

Feb. 25, 2005 (JP) ..... 2005-051637

(51) Int. Cl.
*H01Q 9/04* (2006.01)

(52) U.S. Cl. ..... 343/790; 343/772

(58) Field of Classification Search ..... 343/786, 343/772, 840, 790

See application file for complete search history.

(56) References Cited

U.S. PATENT DOCUMENTS 5,305,000 A * 4/1994 Harris ..... 343/786
5,374,938 A * 12/1994 Hatazawa et al. ..... 343/756
5,475,394 A * 12/1995 Kohls et al. ..... 343/700 MS
6,111,474 A * 8/2000 Nibe ..... 333/26
6,801,789 B1 * 10/2004 Kato ..... 455/562.1
6,967,619 B2 * 11/2005 Khoo et al. ..... 343/700 MS
6,977,614 B2 * 12/2005 Poe et al. ..... 343/700 MS

FOREIGN PATENT DOCUMENTS

| | | |
|---|---|---|
| EP | 1 406 341 A1 | 4/2004 |
| JP | 09-027701 | 1/1997 |
| JP | 09-036618 | 2/1997 |
| JP | 9-55244 A | 2/1997 |
| JP | 10-261902 | 9/1998 |
| JP | 11-041010 | 2/1999 |
| JP | 2000-261202 | 9/2000 |
| JP | 2001-94313 A | 4/2001 |
| JP | 2002-271007 A | 9/2002 |

* cited by examiner

*Primary Examiner*—Tan Ho
(74) *Attorney, Agent, or Firm*—Nixon & Vanderhye P.C.

(57) ABSTRACT

An antenna probe includes an antenna portion having at least a part arranged inside a waveguide, and a connecting portion for connection with a micro-strip line, the connecting portion has a connecting surface to be connected to the micro-strip line, and the connecting surface is formed flat. The antenna portion is formed of a conductor, integral with the connecting portion with a first bent portion therebetween. The antenna probe is formed by bending a plate-shaped conductor.

19 Claims, 8 Drawing Sheets

ANTENNA PROBE HAVING ANTENNA PORTION, LOW NOISE CONVERTER WITH ANTENNA PROBE AND METHOD OF CONNECTING ANTENNA PROBE HAVING ANTENNA PORTION

This nonprovisional application is based on Japanese Patent Application No. 2005-051637 filed with the Japan Patent Office on Feb. 25, 2005, the entire contents of which are hereby incorporated by reference.

BACKGROUND OF THE INVENTION

1. Field of the Invention

The present invention relates to an antenna probe, a low noise converter with an antenna probe, and a method of connecting an antenna probe.

2. Description of the Background Art

For receiving signals of satellite broadcast or satellite communication, a reception system including an antenna apparatus has been used.

FIG. 11 schematically shows a general satellite broadcast receiving system. An incoming signal from a broadcasting satellite 33 represented by an arrow 74 is reflected at a surface of an reflected board 35, and received by a low noise (LNB: Low Noise Block down) converter 32. Low noise converter 32 performs frequency-conversion on weak radio wave of 12 GHz band coming from broadcasting satellite 33 to a signal of an IF (Intermediate Frequency) band of 1 GHz.

Low noise converter 32 amplifies the signal in a low-noise state, and transmits the signal through an IF cable 34 to a DBS (Direct Broadcasting Satellite) tuner 31. The signal from the satellite comes in a frequency, for example, of 12.20 to 12.75 GHz. The signal has its frequency converted by low noise converter 32, and is transmitted to DBS tuner 31 with the frequency of 1000 to 1550 MHz. DBS tuner 31 processes the received signal in an internal circuit, and transmits the resulting signal to a television receiver 30. Television receiver 30 displays an image or a video image based on the received signal.

The area 61 represented by the dotted line is an indoor area and apparatuses herein are arranged indoors. Television receiver 30 and DBS tuner 31 are arranged indoors.

FIG. 12 shows an exemplary block diagram of an electric circuit formed in the low noise converter. The incoming signal having the frequency in 12 GHz band is led to a waveguide in low noise converter 32. Inside the waveguide, antenna probes 52 and 53 are arranged, and the incoming signal is received by antenna probes 52 and 53.

The signal received by antenna probes 52 and 53 is transmitted to an LNA (Low Noise Amplifier) 40. LNA 40 amplifies the signal. LNA 40 includes an amplifier 41 for amplifying an output signal from antenna probe 53, an amplifier 42 for amplifying an output signal from antenna probe 52, and an amplifier 43 for amplifying these output signals.

The signal amplified by LNA 40 is transmitted to a mixer 46 through a filter 45. As filter 45, a BPF (Band Pass Filter) is used, which passes a desired frequency band and filters out a signal in the image frequency band. In mixer 46, an output signal of a local oscillator 48 is synthesized and the signal is converted to have an intermediate frequency. The output signal from mixer 46 is amplified by an intermediate frequency amplifier 47, and transmitted to an output terminal 50 with appropriate noise and gain characteristics. Electric power is supplied by a power source 49 to these components.

Low noise converter 32 includes a waveguide and an antenna probe for receiving the incoming signal.

FIG. 13 is a schematic perspective view of the waveguide having the antenna probe arranged inside. FIG. 14 is a cross section taken along the line XIV-XIV of FIG. 13. The radio wave reflected at the reflected board enters the waveguide in a direction represented by an arrow 71. The incoming signal represented by the arrow 71 includes orthogonally crossing, two polarized waves. The incoming signal includes a plane of polarization parallel to the direction represented by the arrow 75 and a plane of polarization parallel to the direction represented by the arrow 76. The planes of polarization are orthogonal to each other. For example, the signal parallel to the direction of the arrow 75 represents a plane of vertical polarization, while the signal parallel to the direction of the arrow 76 represents a plane of horizontal polarization.

In waveguide 51, antenna probes 52 and 53 for receiving the polarized signals having respective planes of polarization are arranged. Antenna probe 52 receives a signal having the plane of polarization parallel to the direction of the arrow 75, while antenna probe 53 receives a signal having the plane of polarization parallel to the direction of the arrow 76.

Referring to FIG. 14, antenna probes 52 and 53 are arranged such that directions of extension cross orthogonally with each other. Referring to FIG. 13, antenna probes 52 and 53 are arranged apart from each other in a direction of extension of waveguide 51.

Waveguides including such antenna probes are disclosed, for example, in Japanese Patent Laying-Open Nos. 10-261902 and 2000-261202. The antenna probes are formed as bars and fixed on the waveguides.

FIG. 15 is a schematic perspective view of one antenna probe in accordance with the prior art, and FIG. 16 is a schematic perspective view of another antenna probe in accordance with the prior art.

Referring to FIG. 15, an antenna probe 54 includes an antenna portion 56 formed of metal in a circular column and a connecting portion 57 for connection to a circuit board. Connecting portion 57 is formed by processing a tip end of antenna portion 56 as a metal bar. Connecting portion 57 is joined to a micro-strip line formed on the circuit board by soldering.

Referring to FIG. 16, an antenna probe 55 includes an antenna portion 56 formed of a conductor in a circular column, a fixing portion 59 for fixing antenna probe 55 to a box or the like in which the waveguide is formed, and a connecting portion 58 for connection to a circuit board. Fixing portion 59 is formed, for example, of resin, and arranged to surround a portion of antenna portion 56.

FIG. 17 is a schematic perspective view of the antenna probe of FIG. 15 arranged on a waveguide. FIG. 18 is a cross section taken along the line XVIII-XVIII of FIG. 17. FIG. 19 is a plan view of the circuit board in accordance with the prior art.

On a surface of circuit board 6, a micro-strip line 9 is formed, and through micro-strip line 9 and circuit board 6, antenna probe 54 is arranged. Antenna probe 54 is arranged such that a part of antenna portion 56 is positioned inside the waveguide 51. Connecting portion 57 formed at one end of antenna probe 54 is fixed on micro-strip line 9 by soldering.

As can be seen from FIGS. 15 to 18, according to the prior art, a bar-shaped antenna probe is fixed on a box of the waveguide or on a circuit board.

Referring to FIGS. 17 and 18, according to the method of fixing connecting portion 57 of antenna probe 54 to circuit board 6, antenna probe may possibly be inclined in the direction represented by an arrow 72 or 73 when antenna probe 54 is fixed, and hence, assembly has been difficult. Further, if antenna probe 54 should be inclined, it is necessary to adjust the angle of attachment using a jig or the like for correcting inclination, which is very troublesome.

Further, when antenna probe 54 is attached, it is difficult to visually observe antenna portion 56 from the surface side of the circuit board, and hence it is difficult to inspect inclination of antenna probe 54.

SUMMARY OF THE INVENTION

An object of the present invention is to provide an antenna probe allowing easy attachment with high positional accuracy, a low noise converter with the antenna probe and a method of connecting the antenna probe.

The present invention provides an antenna probe including an antenna portion having at least a part arranged inside a waveguide and a connecting portion for connection with a micro-strip line, wherein the connecting portion has a connecting surface to be connected to the micro-strip line, the connecting surface is made flat, and the antenna portion is formed of a conductor, integral with the connecting portion with a first bent portion therebetween. Because of this structure, an antenna probe that allows easy attachment with high positional accuracy can be provided.

Preferably, the antenna probe of the invention is formed by bending the conductor having a plate-shape. Because of this structure, the antenna probe can be formed in a simple manner.

In the invention described above, preferably, the antenna portion is formed to have an L-shape, and the antenna portion includes a receiving portion for receiving a signal. The receiving portion is formed to extend in a direction approximately parallel to the connecting surface. Because of this structure, two antenna probes for receiving the signal including orthogonally crossing two polarized waves can be arranged from one direction into the waveguide.

In the invention described above, preferably, the antenna portion includes a second bent portion and a receiving portion for receiving a signal, and the receiving portion is formed to extend in a direction approximately parallel to the connecting portion. Because of this structure, it becomes possible to apply the present invention to a signal having planes of polarization at an arbitrary angle of inclination.

In the invention described above, preferably, the first bent portion is formed to curve. Alternatively, the first bent portion is chamfered at the protruding portion.

In the invention described above, preferably, a member for suppressing solder flow is formed at least partially on the antenna portion and on the connecting portion. Because of this structure, it becomes possible to prevent solder from flowing to the receiving portion, and hence to prevent degradation in the reception characteristics.

The present invention provides a low noise converter including the antenna probe described above and a circuit board having the micro-strip line arranged on its surface. Because of this structure, a low noise converter allowing easy attachment of the antenna probe with high positional accuracy can be provided.

In the invention described above, preferably, the circuit board includes an opening to which the antenna portion is inserted, and a positioning mark for defining a joining position for the connecting portion on the micro-strip line. As the positioning mark is formed, the position for attaching the antenna probe can easily be determined.

The present invention provides a method of connecting an antenna probe, including: the first step of integrally forming an antenna portion for receiving a signal and a connecting portion to be joined to a micro-strip line, with the connecting portion formed flat; the second step of forming an opening in a circuit board and arranging at least a part of the antenna portion inside a waveguide through the opening; and the third step of joining the connecting portion and the micro-strip line. The first step includes the step of bending a plate-shaped conductor; the second step includes the step of arranging one flat portion of the conductor as the antenna portion inside the waveguide, and the third step includes the step of joining the other flat portion of the conductor as the connecting portion to the micro-strip portion. Because of this method, it becomes possible to easily join the antenna probe to the micro-strip line with high positional accuracy. Further, the antenna probe can be formed easily.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiment 1

Referring to FIGS. 1 to 7, an antenna probe, a low noise converter, and a method of connecting the antenna probe in accordance with Embodiment 1 of the present invention will be described.

Figure 1:
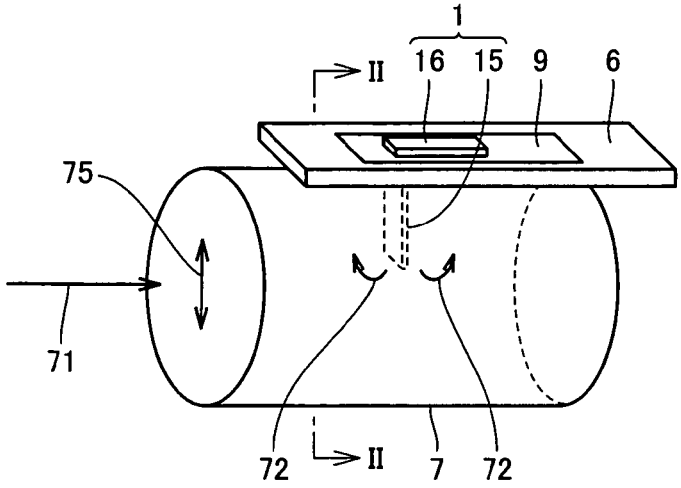
FIG. 1 is a schematic perspective view of a portion of a waveguide in a low noise converter in accordance with Embodiment 1.
Figure 2:
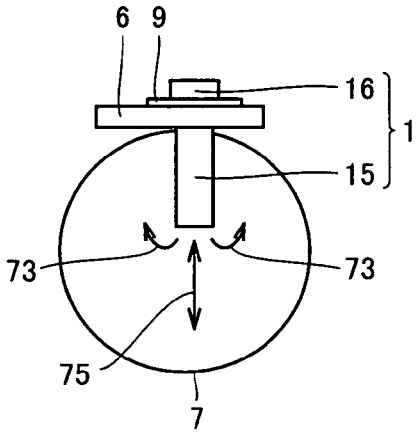
FIG. 2 is a schematic cross-sectional view of a portion of a waveguide in a low noise converter in accordance with Embodiment 1.
Figure 3:
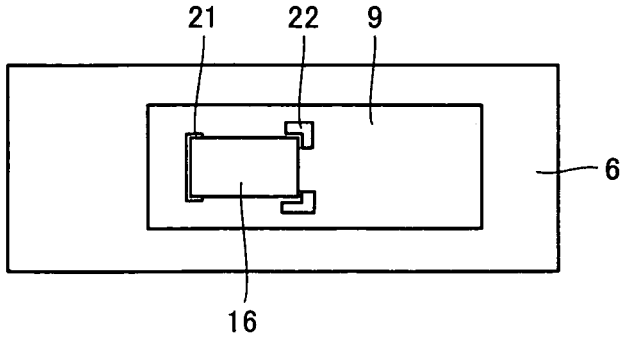
FIG. 3 is a schematic plan view of a circuit board on which the antenna probe of Embodiment 1 is arranged.

FIG. 1 is a schematic perspective view of a portion of a waveguide in a low noise converter in accordance with the present embodiment. FIG. 2 is a cross-sectional view taken along the line II-II of FIG. 1. Further, FIG. 3 is a schematic plan view of the circuit board on which the antenna probe is fixed.

Referring to FIGS. 1 and 2, a waveguide 7 is formed by a tube having a circular cross-section, or by opening a circular, columnar hole in a rectangular columnar material. On waveguide 7, a circuit board 6 is fixed. Circuit board 6 is fixed on waveguide 7 by means of a screw or the like.

On a surface of circuit board 6, a micro-strip line 9 of, for example, copper foil, is formed. Micro-strip line 9 is formed to have a width that corresponds to the frequency of the signal to be propagated, on a surface of a wiring board such as a printed board. The micro-strip line is formed, for example, of a copper foil. By way of example, micro-strip line 9 is formed by a method of placing a copper foil on the surface of circuit board 6 and performing etching thereafter.

On a surface of micro-strip line 9, an antenna probe 1 as a first antenna probe in accordance with the present embodiment is joined. The antenna probe is joined such that a connecting surface of a connecting portion 16 is in contact with the micro-strip line. Connecting portion 16 is connected and fixed on micro-strip line 9 by, for example, soldering.

The incoming signal reflected at the reflected board enters one end of a waveguide 7, as shown by an arrow 71. The antenna probe in accordance with the present embodiment is for receiving signals of linear polarization having planes of polarization parallel to the direction of the arrow 71 and parallel to the direction of the arrow 75.

Figure 4:
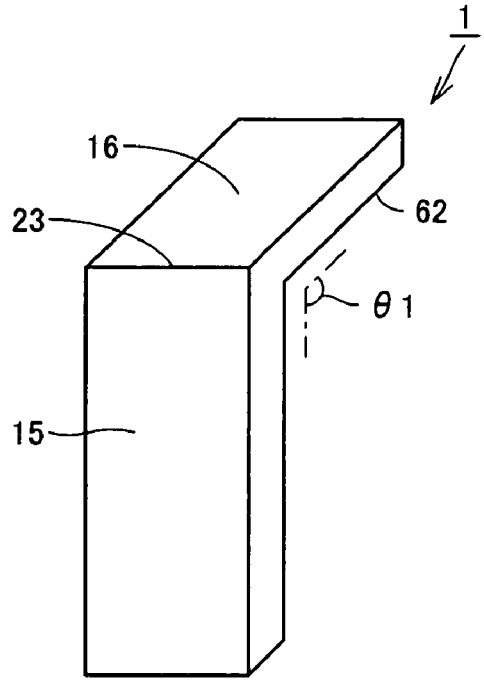
FIG. 4 is a schematic perspective view of a first antenna probe in accordance with Embodiment 1.

FIG. 4 is a schematic perspective view of the first antenna probe in accordance with the present embodiment. Antenna probe 1 includes an antenna portion 15 partially arranged inside the waveguide, and a connecting portion 16 for connection to the micro-strip line.

Connecting portion 16 has a connecting surface 62 to be connected to the micro-strip line. Antenna probe 1 in accordance with the present embodiment is formed by bending a plate-shaped conductor. Connecting portion 16 and antenna portion 15 are each formed in plate-shape. Connecting surface 62 has such a shape that has an outer edge and closed, and the connecting surface 62 is entirely in contact from end to end. In the present embodiment, connecting surface 62 is formed to have an approximately rectangular planer shape, and connecting surface 62 as a whole is joined to the micro-strip line.

Antenna probe 1 has connecting portion 16 and antenna portion 15 formed integrally, with a bent portion 23 as the first bent portion therebetween. The angle θ1 formed by the direction of extension of antenna portion 15 and the direction of extension of connecting portion 16 is adapted to be 90°.

Referring to FIGS. 1 and 2, a part of antenna portion 15 is arranged inside waveguide 7. Antenna portion 15 is formed such that the direction of extension thereof is parallel to the direction of the plane of polarization represented by the arrow 75. Further, antenna portion 15 is formed such that its main surface is approximately vertical to the direction of entrance of the signal represented by the arrow 71.

In antenna probe 1 in accordance with the present embodiment, a connecting surface of connecting portion 16 is formed to be a flat surface, and antenna portion 15 and connecting portion 16 are formed integrally by a conductor. When connecting portion 16 is to be connected to micro-strip line 9, the flat connecting surface 62 is utilized. Antenna probe 1 is joined to micro-strip line 9 with a large contact area. Therefore, antenna probe 1 can easily be attached to circuit board 6 while inclination of antenna probe 1 in the longitudinal direction of waveguide 7 represented by the arrow 72 in FIG. 1 and in the direction vertical to the longitudinal direction of waveguide 7 represented by the arrow 73 in FIG. 2 is prevented. As the antenna probe in accordance with the present invention is employed, productivity of the low noise converter in accordance with the present invention is improved and, in addition, reception characteristic is also improved.

By way of example, connecting portion 16 and antenna portion 15 of antenna probe 1 are formed such that the angle θ1 formed thereby is 90°, and circuit board 6 is fixed on waveguide 7 such that the main surface of circuit board 6 is positioned approximately vertical to the plane of polarization represented by the arrow 75, whereby antenna probe 1 can be joined to micro-strip line 9 without the necessity of strictly adjusting the inclination of antenna portion 15.

Further, after the antenna probe is attached, the state of attachment of the antenna portion can be inspected from the outside, improving operating efficiency. Specifically, by inspecting the position of the connecting portion on the micro-strip line and inclination of the connecting portion, it is possible to find positional deviation or inclination of the antenna portion. Further, for maintenance or repair after use, it is possible to inspect the condition of the antenna portion from the surface side of the circuit board, and hence, operating efficiency can be improved.

Further, the antenna probe in accordance with the present embodiment is formed by bending one, plate-shaped conductor. As to the method of connecting the antenna probe in accordance with the present embodiment, the plate-shaped conductor as the antenna probe is bent, one flat-plate portion is arranged as an antenna portion in the waveguide, and the other flat-plate portion as a connecting portion is connected to the micro-strip line. By adopting this structure or method, the antenna probe can be formed easily.

Referring to FIG. 3, according to the present embodiment, in circuit board 6, micro-strip line 9 and the waveguide, an opening 21 for inserting antenna portion 15 of antenna probe 1 is formed.

Opening 21 has approximately the same cross-sectional shape as that of antenna probe 1. Specifically, opening 21 is formed to limit the movement of antenna probe 1. By adopting this structure, positional deviation of antenna probe 1 can be suppressed.

In the present embodiment, on a surface of micro-strip line 9, a positioning mark 22 defining the connecting position of connecting portion 16 is formed. Positioning mark 22 of the present embodiment is formed to be along the outer side of the area on which connecting portion 16 is to be arranged. Positioning mark 22 is arranged at a portion that corresponds to a corner when connecting portion 16 is viewed two-dimensionally. As positioning mark 22, a conductive pattern of copper foil or a conductive portion, or a resist such as solder resist, may be used.

By providing the positioning mark 22, positioning of the antenna probe on micro-strip line 9 is facilitated. Further, as the antenna probe can be positioned at an accurate position in a simple manner, antenna characteristic can be improved.

As positioning mark 22, any visible material may be used, and one that can be formed simultaneously with formation of the circuit board is preferred. By way of example, use of an interconnection pattern of the circuit board or resist is preferred. By adopting this structure, the positioning mark can be formed simultaneously with formation of other portions of the circuit board, and thus, operating efficiency can be improved.

When it is found at the time of repair or an inspection after assembly that positional accuracy of attachment is out of a tolerable range, the antenna probe is detached for re-assembly. When the antenna probe is to be detached from the circuit board, soldered portion is heated again to melt the solder. The antenna probe of the present invention also improves operating efficiency in such detachment or re-attachment of the antenna probe.

Figure 5:
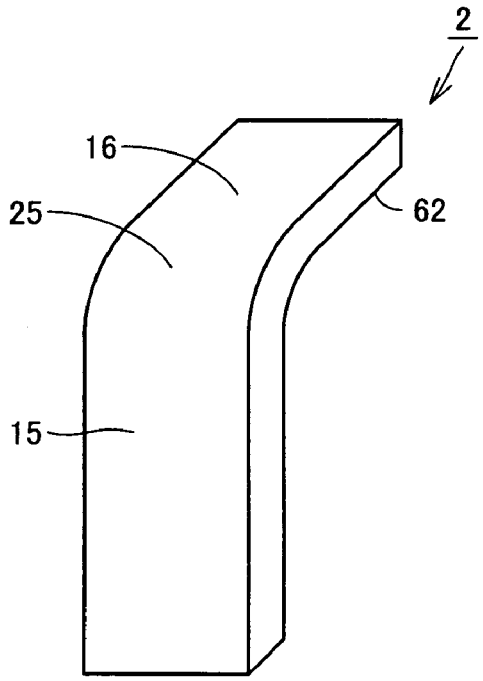
FIG. 5 is a schematic perspective view of a second antenna probe in accordance with Embodiment 1.

FIG. 5 is a schematic perspective view of a second antenna probe in accordance with the present embodiment. An antenna probe 2 as the second antenna probe has the connecting portion 16 and the antenna portion 15 connected at a bent portion 25 as a first bent portion. Bent portion 25 is formed as a curve when viewed from a side. Bent portion 25 is formed to have a curved surface. Antenna probe 2 has its connecting portion 62 joined to be in contact with the micro-strip line, similar to the first antenna probe of the present embodiment. As shown, the first bent portion may be formed as a curve.

Figure 6:
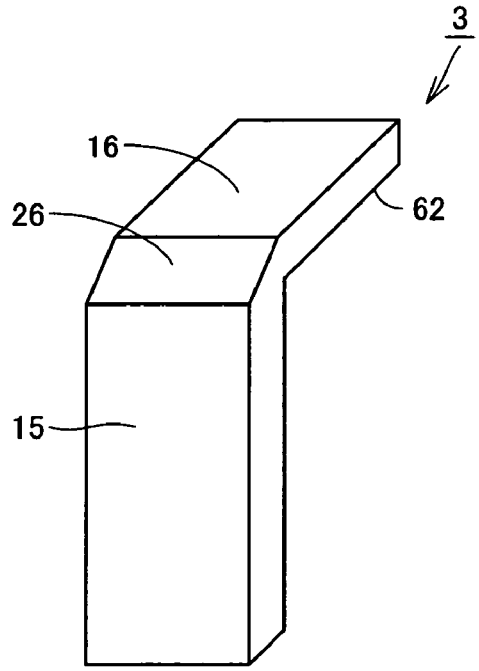
FIG. 6 is a schematic perspective view of a third antenna probe in accordance with Embodiment 1.

FIG. 6 is a schematic perspective view of a third antenna probe in accordance with the present embodiment. An antenna probe 3 as the third antenna probe has the connecting portion 16 and the antenna portion 15 connected with a bent portion 26 as a first bent portion therebetween. Bent portion 26 is formed with the protruding portion chamfered, that is, formed to have a so-called C-surface. Specifically, bent portion 26 has a shape of a bent corner with the top of the corner cut or truncated, when viewed from a side. As shown, the first bent portion may be formed to have a C-surface.

Figure 7:
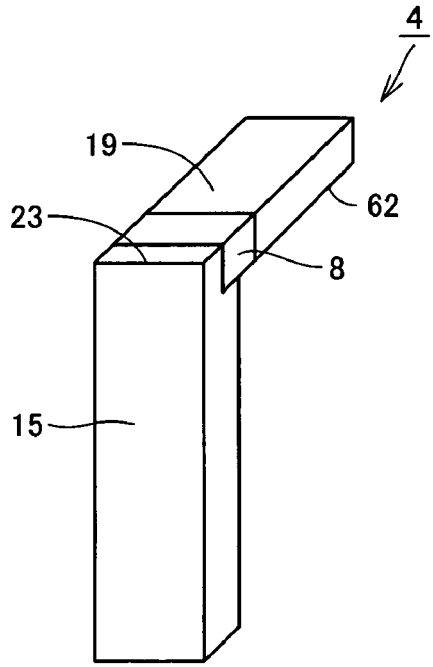
FIG. 7 is a schematic perspective view of a fourth antenna probe in accordance with Embodiment 1.

FIG. 7 is a schematic perspective view of a fourth antenna probe in accordance with the present embodiment. An antenna probe 4 as the fourth antenna probe includes a connecting portion 19 and the antenna portion 15, which are connected to each other at a bent portion 23. In antenna probe 4, at an end of connecting portion 19 on the side of bent portion 23, a resist 8 is formed as a solder flow preventing member. Resist 8 is formed as a band, surrounding connecting portion 19 including connecting surface 62. Resist 8 is formed, by way of example, of solder resist used for the board.

As the solder flow preventing member is formed at parts of antenna portion 15 and connecting portion 19, it becomes possible to prevent the solder from flowing to antenna portion 15. As a result, deviation of characteristics of the antenna itself from the design can be prevented. Further, short circuit caused by the solder flowing from connecting portion 19 can be prevented.

Though a resist is arranged at a portion of the connecting portion as the solder flow preventing member in the present embodiment, it is not limiting, and any member may be formed that can suppress solder flow toward the antenna portion. For instance, the antenna probe may be formed of brass, and plated with tin for soldering on its surface. Not forming the tin plating serves as the solder flow preventing member, in place of the resist. Further, the solder flow preventing member may be arranged near the bent portion of the antenna portion.

Embodiment 2

Figure 8:
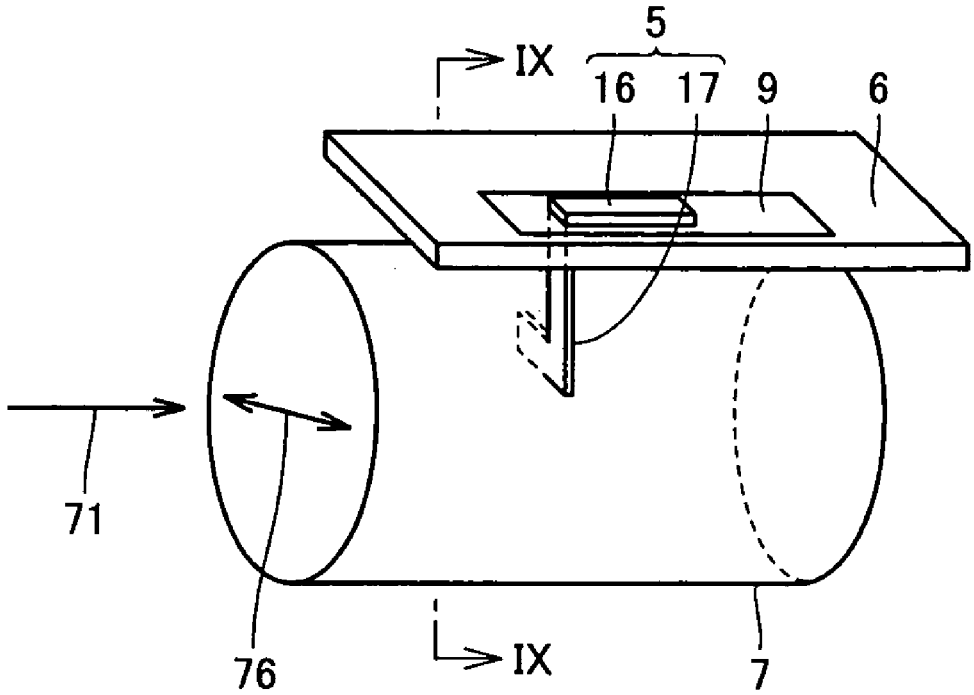
FIG. 8 is a schematic perspective view of a portion of a waveguide in a low noise converter in accordance with Embodiment 2.
Figure 9:
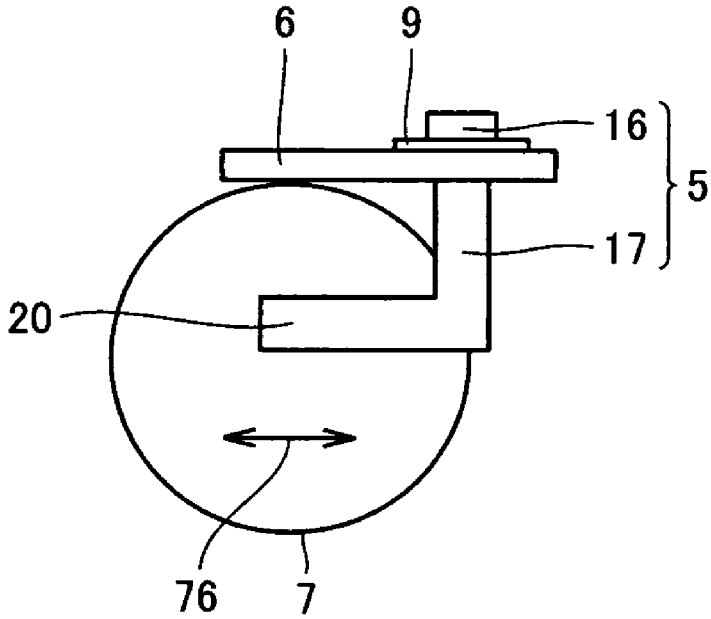
FIG. 9 is a schematic cross-sectional view of a portion of a waveguide in a low noise converter in accordance with Embodiment 2.
Figure 10:
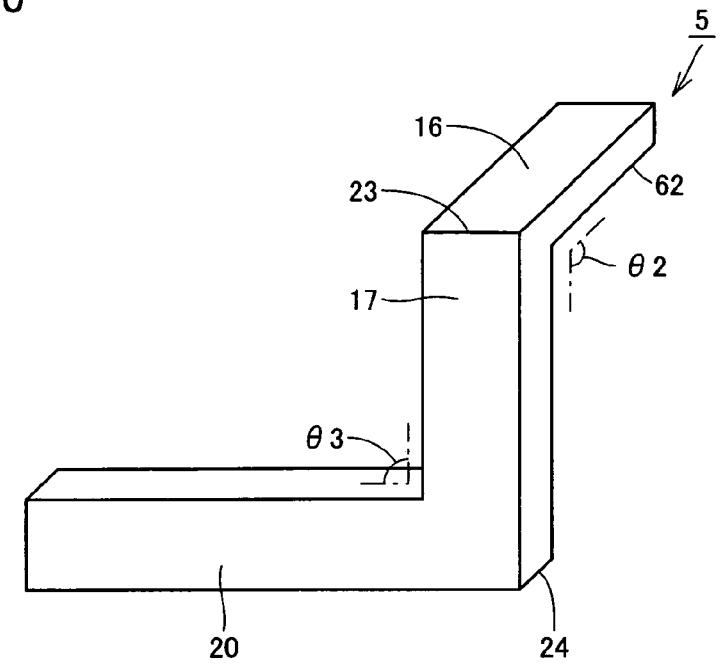
FIG. 10 is a schematic perspective view of an antenna probe in accordance with Embodiment 2.
Figure 11:
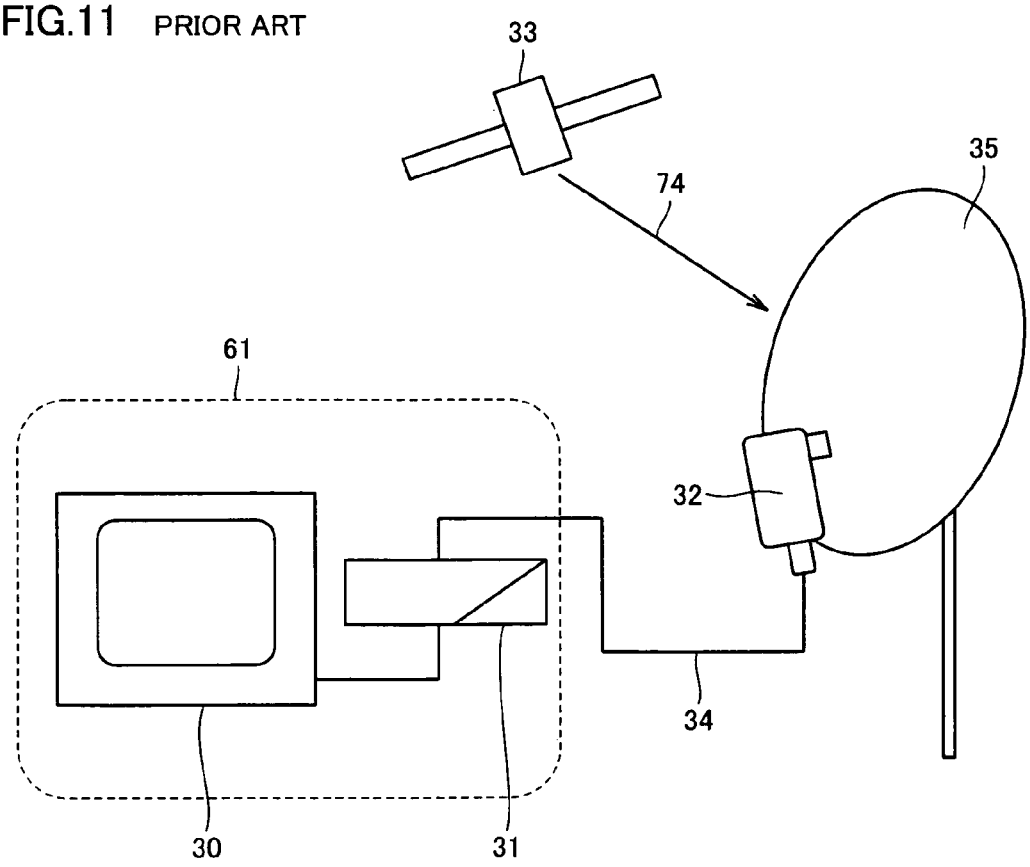
FIG.11 PRIOR ART
FIG. 11 is a schematic illustration of a satellite signal receiving system.
Figure 12:
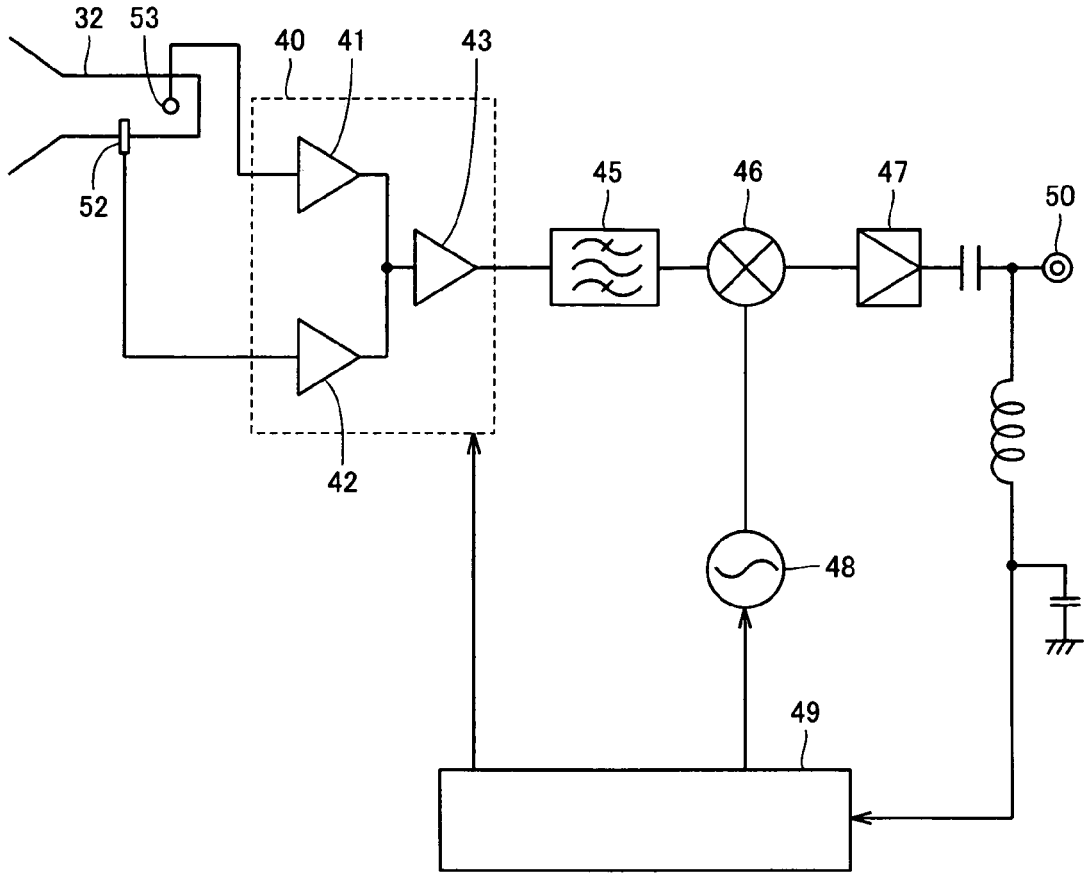
FIG.12 PRIOR ART
FIG. 12 is a block diagram of an electric circuit of a low noise converter.
Figure 13:
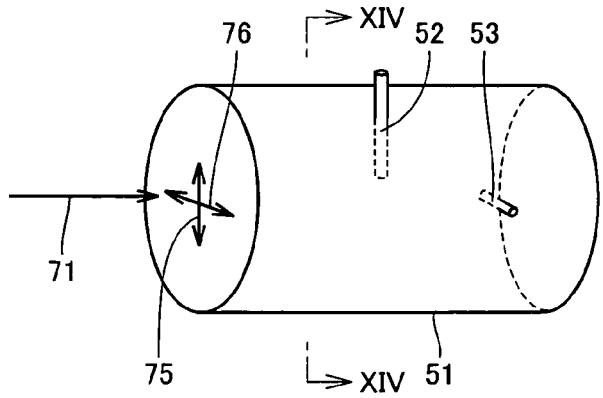
FIG.13 PRIOR ART
FIG. 13 is a schematic perspective view of a waveguide and an antenna probe in a low noise converter in accordance with the prior art.
Figure 14:
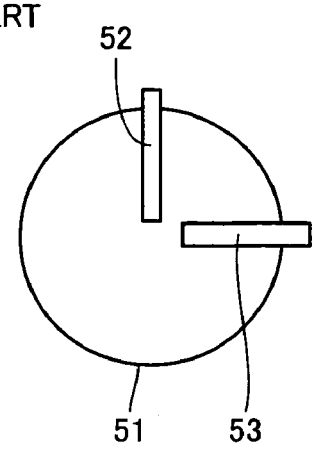
FIG.14 PRIOR ART
FIG. 14 is a schematic cross-sectional view of a waveguide and an antenna probe in a low noise converter in accordance with the prior art.
Figure 15:
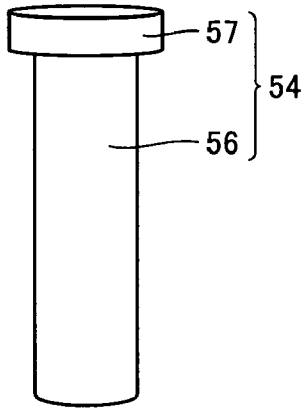
FIG.15 PRIOR ART
FIG. 15 is a schematic perspective view of one antenna probe in accordance with the prior art.
Figure 16:
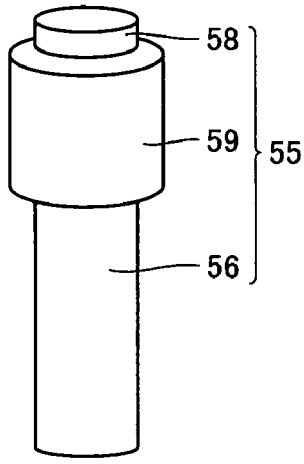
FIG.16 PRIOR ART
FIG. 16 is a schematic perspective view of another antenna probe in accordance with the prior art.
Figure 17:
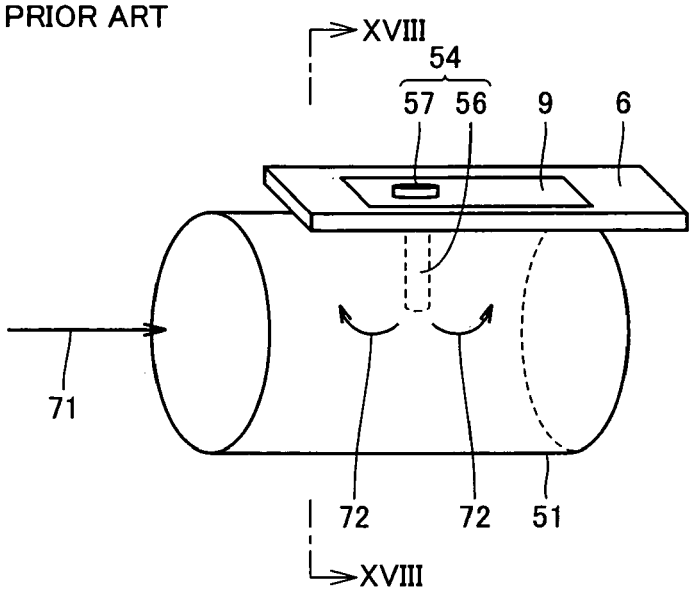
FIG.17 PRIOR ART
FIG. 17 is a schematic perspective view of a portion of a waveguide in a low noise converter in accordance with the prior art.
Figure 18:
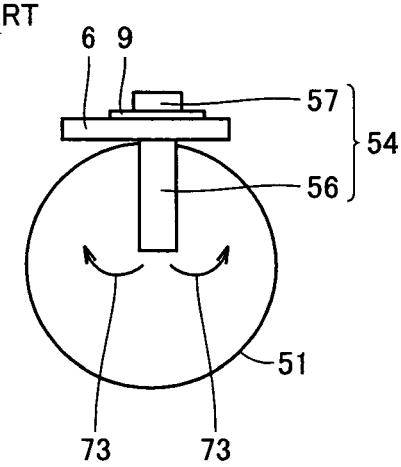
FIG.18 PRIOR ART
FIG. 18 is a schematic cross-sectional view of a portion of a waveguide in a low noise converter in accordance with the prior art.
Figure 19:
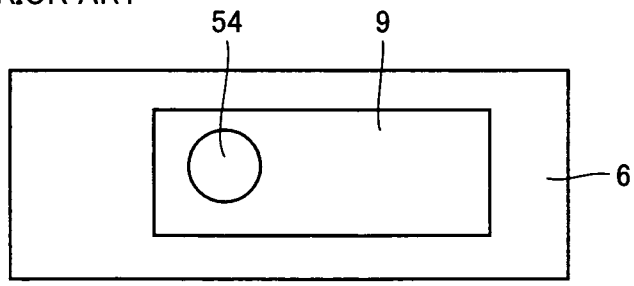
FIG.19 PRIOR ART
FIG. 19 is a schematic plan view of a circuit board in a low noise converter in accordance with the prior art.

Referring to FIGS. 8 to 10, an antenna probe, a low noise converter and a method of connecting the antenna probe in accordance with Embodiment 2 of the present invention will be described.

FIG. 8 is a schematic perspective view of a waveguide portion of a low noise converter in accordance with the present embodiment. FIG. 9 is a cross-sectional view taken along the line IX-IX of FIG. 8. Similar to Embodiment 1, the low noise converter includes a waveguide and a circuit board, and on the surface of the circuit board, a micro-strip line is formed. The low noise converter in accordance with the present embodiment differs in the structure of antenna probe 1 from Embodiment 1.

FIG. 10 is a schematic perspective view of the antenna probe in accordance with the present embodiment. An antenna portion 17 of antenna probe 5 of the present embodiment has a bent portion 24 as a second bent portion, and formed to have a front shape of L. Antenna portion 17 has a receiving portion 20 for receiving a signal. Receiving portion 20 is a portion linearly extending in one direction, of the linear portions extending in two directions of the L-shape.

Connecting portion 16 and antenna portion 17 are connected with bent portion 23 as the first bent portion therebetween. Connecting portion 16 and antenna portion 17 are formed such that an angle θ2 formed thereby at bent portion 23 is 90°. Further, antenna portion 17 is formed such that the angle θ3 of bent portion 24 is 90°.

Referring to FIGS. 8 and 9, a part of receiving portion 20 of antenna portion 17 is arranged inside the waveguide 7. Circuit board 6 is joined to waveguide 7.

The incoming signal proceeds in the direction represented by the arrow 71. The antenna probe in accordance with the present embodiment is formed to receive a signal having planes of polarization parallel to the arrows 76 and 71. Specifically, the antenna probe of the present embodiment is formed to receive a horizontally polarized signal.

Referring to FIG. 9, receiving portion 20 of antenna portion 17 of the present embodiment is formed to extend in a direction approximately parallel to the connecting surface of connecting portion 16. By adopting such a structure, it becomes possible to insert the antenna probe having a linear antenna portion in accordance with Embodiment 1 and the antenna probe having a bent antenna portion in accordance with the present embodiment to the inside of the waveguide from one same direction, and hence, it becomes possible to arrange two antenna probes on one circuit board, or, two antenna probes for receiving signals of orthogonally crossing two polarizations can be arranged on one circuit board in a simple manner.

Referring to FIGS. 9 and 10, in the present embodiment, the angle θ2 formed by connecting portion 16 and antenna portion 17 and the angle θ3 at the bent portion 24 of antenna portion 17 are both adapted to be approximately 90°. Such an arrangement, however, is not limiting, and any angle may be selected provided that the direction of extension of receiving portion 20 is approximately parallel to the plane of polarization of the incoming signal. By adopting such a structure, it becomes possible to insert the antenna probe from any position to the waveguide, and degree of freedom in design can be improved.

Other structures, functions and effects of the antenna probe, the low noise converter and the method of connecting the antenna probe are the same as those of Embodiment 1, and therefore, description thereof will not be repeated here.

Though a low noise converter provided in an antenna apparatus for receiving satellite broadcast has been described in the embodiments above, the present invention is not limited thereto and may be applied to an antenna probe for receiving signals of satellite communication.

In the figures of the embodiments, the same or corresponding portions are denoted by the same reference characters.

According to the present invention, an antenna probe that can be attached easily with high positional accuracy, a low noise converter with the antenna probe, and a method of connecting the antenna probe can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An antenna probe, comprising:

an antenna portion having at least a portion arranged inside a waveguide; and a connecting portion for connection to a micro-strip line; wherein said connecting portion has a connecting surface to be connected to said micro-strip line;

said connecting surface is formed flat;

said antenna portion and said connecting portion are formed integrally by a conductor with a first bent portion therebetween;

said antenna portion is formed to have an L-shape;

said antenna portion includes a receiving portion for receiving a signal; and said receiving portion is formed to extend in a direction approximately parallel to said connecting surface.

2. The antenna probe according to claim 1, formed by bending plate-shaped said conductor.

3. The antenna probe according to claim 1, wherein said first bent portion is formed to curve.

4. The antenna probe according to claim 1, wherein solder flow suppressing means is formed on at least a part of said antenna portion and of said connecting portion.

5. An antenna probe, comprising:

an antenna portion having at least a portion arranged inside a waveguide; and a connecting portion for connection to a micro-strip line; wherein said connecting portion has a connecting surface to be connected to said micro-strip line;

said connecting surface is formed flat;

said antenna portion and said connecting portion are formed integrally by a conductor with a first bent portion therebetween;

said antenna portion includes a second bent portion;

said antenna portion includes a receiving portion for receiving a signal; and said receiving portion is formed to extend in a direction parallel to a plane of polarization of an incoming signal.

6. The antenna probe according to claim 5, wherein said antenna portion is formed to have an L-shape;

said antenna portion includes a receiving portion for receiving a signal; and said receiving portion is formed to extend in a direction approximately parallel to said connecting surface.

7. The antenna probe according to claim 5, formed by bending plate-shaped said conductor.

8. The antenna probe according to claim 5, wherein said first bent portion is formed to curve.

9. The antenna probe according to claim 5, wherein solder flow suppressing means is formed on at least a part of said antenna portion and of said connecting portion.

10. An antenna probe, comprising:

an antenna portion having at least a portion arranged inside a waveguide; and a connecting portion for connection to a micro-strip line; wherein said connecting portion has a connecting surface to be connected to said micro-strip line;

said connecting surface is formed flat;

said antenna portion and said connecting portion are formed integrally by a conductor with a first bent portion therebetween; and wherein said first bent portion has a protruded portion chamfered.

11. The antenna probe according to claim 10, formed by bending plate-shaped said conductor.

12. The antenna probe according to claim 10, wherein said first bent portion is formed to curve.

13. The antenna probe according to claim 10, wherein solder flow suppressing means is formed on at least a part of said antenna portion and of said connecting portion.

14. A low noise converter, comprising:

an antenna probe;

a circuit board having a micro-strip line arranged on its surface; wherein said antenna probe includes an antenna portion having at least a portion arranged inside a waveguide, a connecting portion for connection to the micro-strip line;

said connecting portion has a connecting surface to be connected to said micro-strip line;

said connecting surface is formed flat; and said antenna portion and said connecting portion are formed integrally by a conductor with a first bent portion therebetween;

said antenna portion is formed to have an L-shape;

said antenna portion includes a receiving portion for receiving a signal; and said receiving portion is formed to extend in a direction approximately parallel to said connecting surface.

15. The low noise converter according to claim 14, wherein said circuit board includes an opening to which said antenna portion is inserted, and a positioning mark for defining a joining point of said connecting portion on said micro-strip line.

16. A low noise converter, comprising:

an antenna probe;

a circuit board having a micro-strip line arranged on its surface; wherein said antenna probe includes an antenna portion having at least a portion arranged inside a waveguide, a connecting portion for connection to the micro-strip line;

said connecting portion has a connecting surface to be connected to said micro-strip line;

said connecting surface is formed flat; and said antenna portion and said connecting portion are formed integrally by a conductor with a first bent portion therebetween;

said antenna portion includes a second bent portion;

said antenna portion includes a receiving portion for receiving a signal; and said receiving portion is formed to extend in a direction parallel to a plane of polarization of an incoming signal.

17. The low noise converter according to claim 16, wherein said circuit board includes an opening to which said antenna portion is inserted, and a positioning mark for defining a joining point of said connecting portion on said micro-strip line.

18. A low noise converter, comprising:

an antenna probe;

a circuit board having a micro-strip line arranged on its surface; wherein said antenna probe includes an antenna portion having at least a portion arranged inside a waveguide, a connecting portion for connection to the micro-strip line;

said connecting portion has a connecting surface to be connected to said micro-strip line;

said connecting surface is formed flat;

said antenna portion and said connecting portion are formed integrally by a conductor with a first bent portion therebetween; and wherein said first bent portion has a protruded portion chamfered.

19. The low noise converter according to claim 18, wherein said circuit board includes an opening to which said antenna portion is inserted, and a positioning mark for defining a joining point of said connecting portion on said micro-strip line.

* * * * *